US011753755B2

(12) United States Patent
Lu et al.

(10) Patent No.: US 11,753,755 B2
(45) Date of Patent: Sep. 12, 2023

(54) BRAIDED TUBE FORMATION APPARATUS AND METHODS OF USE

(71) Applicant: ACCUMEDICAL BEIJING LTD., Beijing (CN)

(72) Inventors: Yiran Lu, Beijing (CN); Hongliang Gao, Beijing (CN); Jiaxing Jia, Beijing (CN)

(73) Assignee: ACCUMEDICAL BEIJING LTD., Beijing (CN)

( * ) Notice: Subject to any disclaimer, the term of this patent is extended or adjusted under 35 U.S.C. 154(b) by 108 days.

(21) Appl. No.: 17/515,649

(22) Filed: Nov. 1, 2021

(65) Prior Publication Data

US 2023/0011914 A1 Jan. 12, 2023

(30) Foreign Application Priority Data

Jul. 9, 2021 (CN) ..... 202110778273.9

(51) Int. Cl.
*D04C 3/40* (2006.01)
*D04C 1/06* (2006.01)
*D04C 3/48* (2006.01)

(52) U.S. Cl.
CPC ..... *D04C 3/40* (2013.01); *D04C 1/06* (2013.01); *D04C 3/48* (2013.01); *D10B 2509/06* (2013.01)

(58) Field of Classification Search
CPC ..... D04C 1/06; D04C 3/40; D04C 3/48
See application file for complete search history.

(56) References Cited

U.S. PATENT DOCUMENTS

| | | | | |
|---|---|---|---|---|
| 6,027,779 | A * | 2/2000 | Campbell | A61L 29/041 428/36.1 |
| 7,578,153 | B2 * | 8/2009 | Hedegaard | C14B 1/58 69/19.1 |
| 8,863,560 | B2 * | 10/2014 | Pedersen | C14B 1/26 69/19.2 |
| 10,010,654 | B2 * | 7/2018 | Jacoby | B29C 53/56 |
| 2010/0083815 | A1 * | 4/2010 | Inazawa | B29C 70/32 87/9 |
| 2018/0056610 | A1 * | 3/2018 | Osborne | B29C 70/386 |

* cited by examiner

*Primary Examiner* — Shaun R Hurley
(74) *Attorney, Agent, or Firm* — MASTER KEY IP, LLP; Justin G. Sanders

(57) ABSTRACT

A braided tube formation apparatus and associated methods of use are disclosed for assisting in the manufacture of a braided tube. In at least one embodiment, the apparatus provides at least one elongated core mandrel, and at least one elongated, radially collapsible primary tube sized and configured for removably receiving the at least one elongated core mandrel therewithin. Each of the at least one primary tube provides a plurality of spaced apart primary tube portions circumferentially arranged and configured for cooperating to define said primary tube. During use, after the braided tube is circumferentially formed on an outer surface of the at least one primary tube, the at least one core mandrel is removed from within the at least one primary tube, thereby allowing the primary tube portions to radially move inwardly toward one another so that braided tube may be disengaged from the at least one primary tube.

20 Claims, 3 Drawing Sheets

BRAIDED TUBE FORMATION APPARATUS AND METHODS OF USE

RELATED APPLICATIONS

This application claims priority and is entitled to the filing date of China application serial number CN 2021107782739, filed on Jul. 9, 2021. The contents of the aforementioned application are incorporated herein by reference.

BACKGROUND

The subject of this patent application relates generally to braided tubes, and more particularly to a braided tube formation apparatus and associated methods of use for manufacturing braided tubes more efficiently and with a relatively higher success rate as compared to traditional methods of manufacture.

Applicant hereby incorporates herein by reference any and all patents and published patent applications cited or referred to in this application.

By way of background, traditional methods of manufacturing braided tubes (such as vascular stents, for example) involve wrapping wires around a core mandrel, allowing the wires to cross each other in a desired pattern to form a braided structure. Heat is then used to set the braided structure, and the braided tube is subsequently removed from the core mandrel by pulling and/or sliding the braided tube off of the core mandrel. Because the wires are in a stretched, strained state when braided, the heat-set braided structure wraps tightly around the surface of the core mandrel due to tension in the wires, which makes it difficult to separate the braided tube from the core mandrel. If the separation is not performed carefully, the braided tube can be damaged, thereby decreasing the production yield. Additionally, because of these separation issues, the lengths of such braided tubes have traditionally been fairly limited in order to reduce the likelihood of damage. Accordingly, there remains a need for a solution that allows for such braided tubes to be manufactured more efficiently and with a relatively higher success rate as compared to traditional methods of manufacture, regardless of the length being manufactured.

Aspects of the present invention fulfill these needs and provide further related advantages as described in the following summary.

It should be noted that the above background description includes information that may be useful in understanding aspects of the present invention. It is not an admission that any of the information provided herein is prior art or relevant to the presently claimed invention, or that any publication specifically or implicitly referenced is prior art.

SUMMARY

Aspects of the present invention teach certain benefits in construction and use which give rise to the exemplary advantages described below.

The present invention solves the problems described above by providing a braided tube formation apparatus and associated methods of use for assisting in the manufacture of a braided tube. In at least one embodiment, the apparatus provides an at least one elongated core mandrel, and an at least one elongated, radially collapsible primary tube sized and configured for removably receiving the at least one elongated core mandrel therewithin, such that the at least one core mandrel is coaxially positionable at least partially within the at least one primary tube. An outer surface of the at least one primary tube is configured for the braided tube to be circumferentially formed thereon. Each of the at least one primary tube provides a plurality of spaced apart primary tube portions circumferentially arranged and configured for cooperating to define said primary tube. During use of the apparatus, after the braided tube is circumferentially formed on the outer surface of the at least one primary tube, the at least one core mandrel is removed from within the at least one primary tube, thereby allowing the primary tube portions to radially move inwardly toward one another so that braided tube may be disengaged from the at least one primary tube.

Other features and advantages of aspects of the present invention will become apparent from the following more detailed description, taken in conjunction with the accompanying drawings, which illustrate, by way of example, the principles of aspects of the invention.

BRIEF DESCRIPTION OF THE DRAWINGS

The accompanying drawings illustrate aspects of the present invention. In such drawings.

The above described drawing figures illustrate aspects of the invention in at least one of its exemplary embodiments, which are further defined in detail in the following description. Features, elements, and aspects of the invention that are referenced by the same numerals in different figures represent the same, equivalent, or similar features, elements, or aspects, in accordance with one or more embodiments.

DETAILED DESCRIPTION

Figure 1:
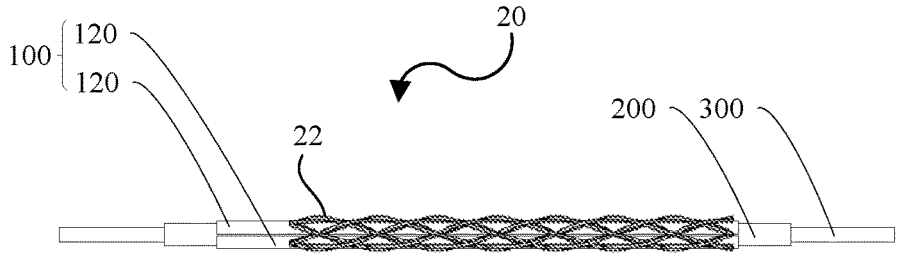
FIG. 1 is a side elevational view of an exemplary braided tube formation apparatus, in accordance with at least one embodiment.
Figure 2:
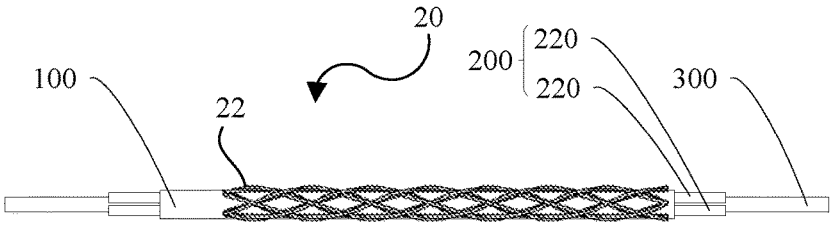
FIG. 2 is a top plan view thereof, in accordance with at least one embodiment.
Figure 3:
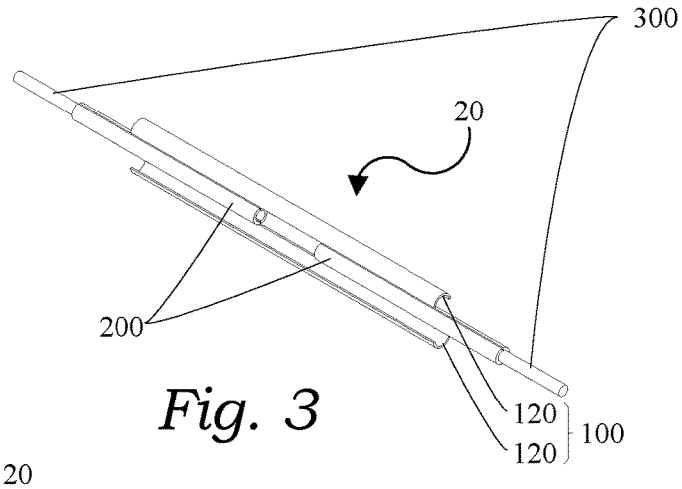
FIG. 3 is a partially exploded view thereof, in accordance with at least one embodiment.

Turning now to FIGS. 1-3, there is shown an exemplary embodiment of a braided tube formation apparatus 20 configured for assisting in the manufacture of a braided tube 22. At the outset, it should be noted that while certain types of braided tubes 22 may be mentioned herein for illustrative purposes, the present invention should not be read as being so limited. Instead, various embodiments of the present invention may be utilized to manufacture any type of braided tube 22 for any industry, now known or later developed.

With continued reference to FIGS. 1-3, in at least one embodiment, the apparatus 20 provides an at least one elongated, radially collapsible primary tube 200 sized and configured for removably receiving an at least one elongated core mandrel 300 therewithin, such that the at least one core mandrel 300 is coaxially positionable at least partially within the at least one primary tube 200. In at least one embodiment, the at least one primary tube 200 has an inner diameter that approximates an outer diameter of the at least one core mandrel 300. In at least one embodiment, the apparatus 20 further provides an at least one elongated, radially collapsible secondary tube 100 sized and configured for removably receiving the at least one primary tube 200 therewithin, such that the at least one primary tube 200 is coaxially positionable at least partially within the at least one secondary tube 100. In at least one embodiment, the at least one secondary tube 100 has an inner diameter that approximates an outer diameter of the at least one primary tube 200. In at least one embodiment, an outer surface of the at least one secondary tube 100 is configured for the braided tube 22 to be circumferentially formed thereon, as discussed further below. In at least one alternate embodiment, the at least one secondary tube 100 is omitted, such that an outer surface of the at least one primary tube 200 is configured for the braided tube 22 to be circumferentially formed thereon. In at least one embodiment, the at least one core mandrel 300 is also tubular (i.e., hollow) in structure; however, in at least one alternate embodiment, the at least one core mandrel 300 is solid.

In at least one embodiment, as illustrated in FIG. 3, a terminal end of the at least one primary tube 200 extends a distance beyond a terminal end of the at least one secondary tube 100, which allows the terminal end of the at least one primary tube 200 to be grasped (either manually or mechanically) and pulled in order to remove the at least one primary tube 200 from the at least one secondary tube 100, as discussed further below. Similarly, in at least one embodiment, a terminal end of the at least one core mandrel 300 extends a distance beyond the terminal end of the at least one primary tube 200, which allows the terminal end of the at least one core mandrel 300 to be grasped (either manually or mechanically) and pulled in order to remove the at least one core mandrel 300 from the at least one primary tube 200, as also discussed further below. With continued reference to FIG. 3, in at least one embodiment, the apparatus 20 provides a plurality of linearly aligned primary tubes 200 positioned at least partially within the at least one secondary tube 100, with each of the primary tubes 200 having a core mandrel 300 partially positioned therewithin. Additionally, in at least one such embodiment, the primary tubes 200 are linearly spaced apart from one another, thereby decreasing the amount of surface contact and friction between the primary tubes 200 and the at least one secondary tube 100 which, in turn, allows for relatively easier removal of the primary tubes 200 from the at least one secondary tube 100. In at least one further embodiment, the apparatus 20 provides a plurality of linearly aligned secondary tubes 100. In at least one such further embodiment, the secondary tubes 100 are linearly spaced apart from one another, thereby decreasing the amount of surface contact and friction between the secondary tubes 100 and the braided tube 22 which, in turn, allows for relatively easier removal of the secondary tubes 100 from the braided tube 22.

In at least one embodiment, each of the at least one primary tube 200 has an outer diameter of between approximately 0.3 millimeters and approximately 58 millimeters, and each of the at least one secondary tube 100 has an outer diameter of between approximately 0.5 millimeters and approximately 60 millimeters. Additionally, in at least one embodiment, each of the at least one primary tube 200 has a length of between approximately 5 millimeters and approximately 200 millimeters, and each of the at least one secondary tube 100 has a length of between approximately 5 millimeters and approximately 300 millimeters. However, in further embodiments, each of the at least one primary tube 200 and secondary tube 100 may have any other diameters and/or lengths, now known or later conceived, so long as the apparatus 20 is capable of substantially carrying out the functionality described herein. In at least one alternate embodiment, each of the at least one primary tube 200 has a tapered outer diameter and a uniform inner diameter. In at least one further alternate embodiment, each of the at least one primary tube 200 has a uniform outer diameter and a tapered inner diameter. In at least one still further alternate embodiment, each of the at least one primary tube 200 has a tapered outer diameter and a tapered inner diameter. Similarly, in at least one alternate embodiment, each of the at least one secondary tube 100 has a tapered outer diameter and a uniform inner diameter. In at least one further alternate embodiment, each of the at least one secondary tube 100 has a uniform outer diameter and a tapered inner diameter. In at least one still further alternate embodiment, each of the at least one secondary tube 100 has a tapered outer diameter and a tapered inner diameter.

Figure 4:
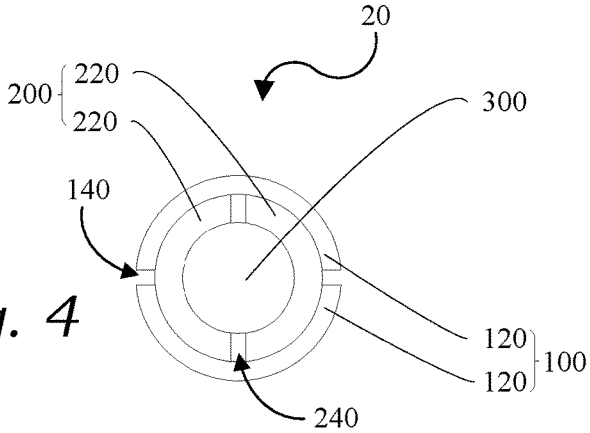
FIG. 4 is an end elevational view thereof, in accordance with at least one embodiment.
Figure 5:
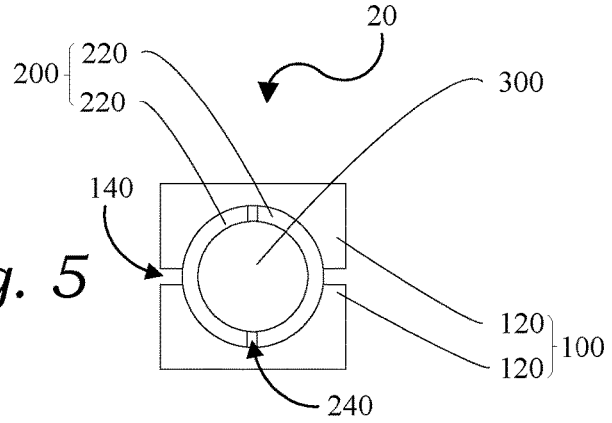
FIG. 5 is an end elevational view of a further exemplary braided tube formation apparatus, in accordance with at least one embodiment.
Figure 6:
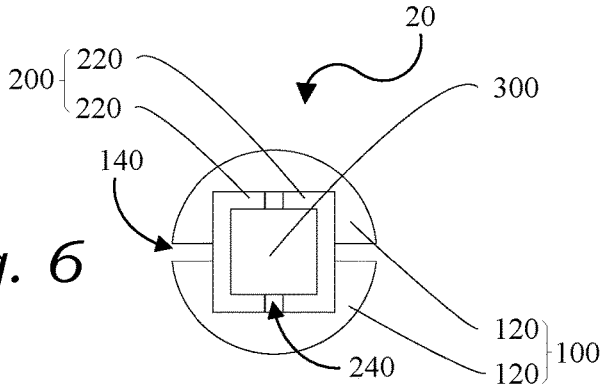
FIG. 6 is an end elevational view of a still further exemplary braided tube formation apparatus, in accordance with at least one embodiment.

In at least one embodiment, as best illustrated in FIG. 4, each of the at least one primary tube 200 is comprised of a plurality of spaced apart primary tube portions 220 circumferentially arranged and configured for cooperating to define said primary tube 200. Thus, as discussed further below, when the at least one core mandrel 300 is removed from within the at least one primary tube 200, the primary tube portions 220 are capable of radially moving inwardly toward one another, such that the outer diameter of the at least one primary tube 200, in turn, decreases. Similarly, in at least one embodiment, each of the at least one secondary tube 100 is comprised of a plurality of spaced apart secondary tube portions 120 circumferentially arranged and configured for cooperating to define said secondary tube 100. Thus, as also discussed further below, when the outer diameter of the at least one primary tube 200 decreases (or, alternatively, when the at least one primary tube 200 is removed from within the at least one secondary tube 100), the secondary tube portions 120 are capable of radially moving inwardly toward one another, such that an outer diameter of the at least one secondary tube 100, in turn, decreases. In that regard, it should be noted that the sizes, shapes, dimensions, quantities and relative positions of each of the primary tube portions 220, secondary tube portions 120 and core mandrel 300 depicted in the drawings are merely illustrative, such that in further embodiments, the primary tube portions 220, secondary tube portions 120 and core mandrel 300 may each take on any other sizes, shapes, dimensions, quantities and/or relative positions now known or later developed—including but in no way limited to those depicted in FIG. 5 (wherein the at least one primary tube 200 and core mandrel 300 are substantially circular in cross-section, while the at least one secondary tube 100 is substantially square or rectangular in cross-section) and FIG. 6 (wherein the at least one primary tube 200 and core mandrel 300 are substantially square or rectangular in cross-section, while the at least one secondary tube 100 is substantially circular in cross-section)—so long as the apparatus 20 is capable of substantially carrying out the functionality described herein.

In at least one embodiment, the primary tube portions 220 are positioned so as to define a primary tube space 240 between adjacent ones of each of the primary tube portions 220. Similarly, in at least one embodiment, the secondary tube portions 120 are positioned so as to define a secondary tube space 140 between adjacent ones of each of the secondary tube portions 120. In at least one embodiment, the primary tube portions 220 are circumferentially oriented relative to the secondary tube portions 120 such that the primary tube spaces 240 are substantially not aligned with the secondary tube spaces 140, thereby preventing the secondary tube portions 120 from causing the primary tube portions 220 to radially collapse unintentionally. In at least one embodiment, each of the primary tube spaces 240 has a width of between approximately 0.001 inches and approximately 0.005 inches, and each of the secondary tube spaces 140 has a width of between approximately 0.001 inches and approximately 0.010 inches. However, in further embodiments, each of the primary tube spaces 240 and secondary tube spaces 140 may have any other widths, now known or later conceived, so long as the apparatus 20 is capable of substantially carrying out the functionality described herein. In at least one alternate embodiment (not shown), the at least one primary tube 200 provides a connector spanning each primary tube space 240, each connector being constructed out of a deformable material so as to interconnect adjacent ones of each of the primary tube portions 220 while still allowing the primary tube portions 220 to radially move inwardly toward one another when the at least one core mandrel 300 is removed from within the at least one primary tube 200. Similarly, in at least one alternate embodiment (also not shown), the at least one secondary tube 100 provides a connector spanning each secondary tube space 140, each connector being constructed out of a deformable material so as to interconnect adjacent ones of each of the secondary tube portions 120 while still allowing the secondary tube portions 120 to radially move inwardly toward one another when the at least one primary tube 200 is removed from within the at least one secondary tube 100 (or, alternatively, when the outer diameter of the at least one primary tube 200 decreases).

In at least one embodiment, the at least one primary tube 200 is removably engaged with the at least one core mandrel 300, so as to prevent the at least one core mandrel 300 from being unintentionally removed from within the at least one primary tube 200. In at least one such embodiment, an inner surface of the at least one primary tube 200 (or, alternatively, the outer surface of the at least one core mandrel 300) provides a temporary engagement material positioned and configured for creating a removable engagement between the inner surface of the at least one primary tube 200 and the outer surface of the at least one core mandrel 300. In at least one such embodiment, the temporary engagement material is an adhesive configured for breaking down upon being exposed to specific temperatures or liquid solutions, thereby allowing the at least one primary tube 200 to separate from the at least one core mandrel 300. In at least one alternate such embodiment, the temporary engagement material is a detachable connection (such as threading, breakaway structures, magnets, hook-and-loop fasteners, etc.). In further such embodiments, any other material or mechanism (or combination thereof), now known or later developed, capable of creating a removable engagement between the at least one primary tube 200 and the at least one core mandrel 300, may be substituted, so long as the apparatus 20 is capable of substantially carrying out the functionality described herein. Similarly, in at least one embodiment, the at least one secondary tube 100 is removably engaged with the at least one primary tube 200, so as to prevent the at least one primary tube 200 from being unintentionally removed from within the at least one secondary tube 100. In at least one such embodiment, an inner surface of the at least one secondary tube 100 (or, alternatively, the outer surface of the at least one primary tube 200) provides a temporary engagement material positioned and configured for creating a removable engagement between the inner surface of the at least one secondary tube 100 and the outer surface of the at least one primary tube 200. In at least one such embodiment, the temporary engagement material is an adhesive configured for breaking down upon being exposed to specific temperatures or liquid solutions, thereby allowing the at least one secondary tube 100 to separate from the at least one primary tube 200. In at least one alternate such embodiment, the temporary engagement material is a detachable connection (such as threading, breakaway structures, magnets, hook-and-loop fasteners, etc.). In further such embodiments, any other material or mechanism (or combination thereof), now known or later developed, capable of creating a removable engagement between the at least one secondary tube 100 and the at least one primary tube 200, may be substituted, so long as the apparatus 20 is capable of substantially carrying out the functionality described herein.

Figure 7:
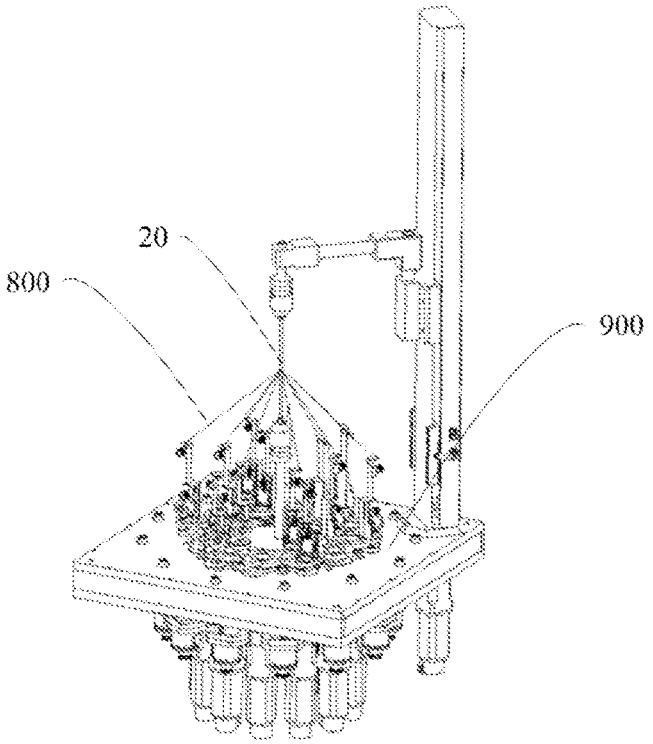
FIG. 7 is a perspective view of an exemplary braided tube formation apparatus engaged with an exemplary braiding machine, in accordance with at least one embodiment.
Figure 8:
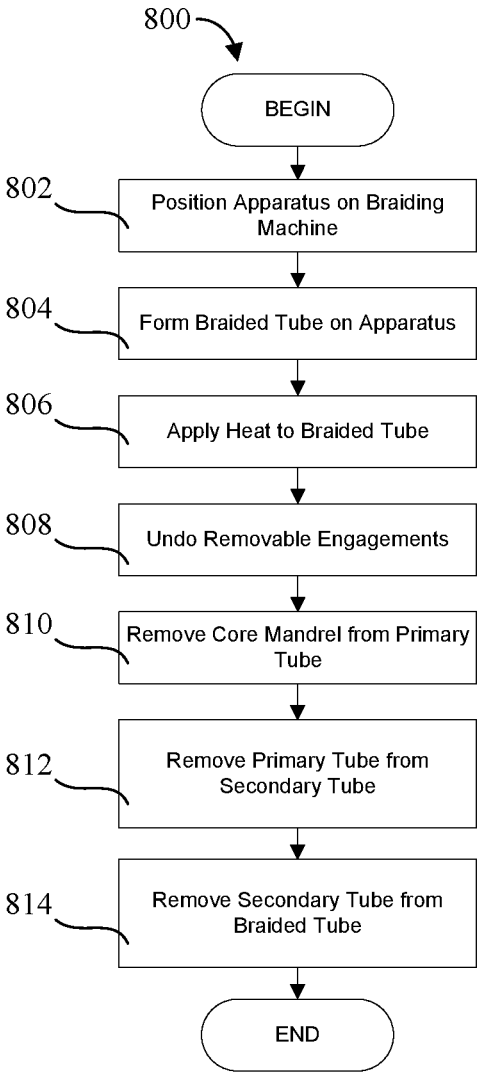
FIG. 8 is a flow diagram illustrating an exemplary method of manufacturing a braided tube using an exemplary braided tube formation apparatus, in accordance with at least one embodiment.

In at least one embodiment, as illustrated in the flow diagram of FIG. 8, the apparatus 20 may be utilized to manufacture a braided tube 22 by first positioning the at least one core mandrel 300 within a traditional braiding machine 900 (802), such as the braiding machine 900 illustrated in FIG. 7 for example. A plurality of wires 800 are then braided circumferentially around the outer surface of the at least one secondary tube 100 (or, alternatively, around the outer surface of the at least one primary tube 200 in embodiments where the at least one secondary tube 100 is omitted) in order to form the braided tube 22 (804). Heat is subsequently applied to the wires 800 of the braided tube 22 in order to set the shape of the braided tube 22 (806). In embodiments where the at least one primary tube 200 is removably engaged with the at least one core mandrel 300, and/or the at least one secondary tube 100 is removably engaged with the at least one primary tube 200, said engagements are either manually or automatically undone (808). In at least one embodiment, where a temperature-sensitive adhesive is used for the removable engagement, the adhesive may be configured for breaking down upon being exposed to the heat from setting the shape of the braided tube 22 in step 806, thereby performing both steps 806 and 808 simultaneously. The at least one core mandrel 300 is removed from within the at least one primary tube 200 (810), thereby allowing the at least one primary tube 200 to radially collapse so that the primary tube portions 220 may be removed (812). In embodiments where the braided tube 22 is formed on the outer surface of the at least one primary tube 200, the primary tube portions 220 are removed from within the braided tube 22, leaving behind the manufactured braided tube 22. In embodiments where the braided tube 22 is formed on the outer surface of the at least one secondary tube 100, the primary tube portions 220 are removed from within the at least one secondary tube 100, thereby allowing the at least one secondary tube 100 to radially collapse so that the secondary tube portions 120 may be removed from within the braided tube 22 (814), leaving behind the manufactured braided tube 22. Thus, unlike traditional methods of manufacturing braided tubes 22, no frictional forces are exerted upon the braided tube 22 as the components of the apparatus 20 are disengaged and removed, thereby sparing the braided tube 22 from damage and increasing the success rate of braided tube 22 production.

In at least one further embodiment (not shown), the apparatus 20 provides an at least one elongated, radially collapsible intermediate tube positioned coaxially between the at least one primary tube 200 and the at least one secondary tube 100, thereby allowing the apparatus 20 to be more gradually disassembled after the braided tube 22 has been formed on the outer surface of the at least one secondary tube 100. In at least one such embodiment, a temporary engagement material (such as those described above, for example) may be utilized to create a removable engagement between each of the at least one secondary tube 100, intermediate tube, primary tube 200 and core mandrel 300.

As mentioned above, various embodiments of the apparatus 20 may be utilized to manufacture any type of braided tube 22 for any industry, now known or later developed, including but in no way limited to wire mesh stents, tubular stents, circular stents, balloon expandable stents, self-expandable stents, intravascular flow disruption devices, blockage devices, delivery devices, distal protective devices, coil devices, etc. Additionally, the braided tubes 22 may be formed using any braiding pattern now known or later developed.

Aspects of the present specification may also be described as the following embodiments:

1. A braided tube formation apparatus for assisting in the manufacture of a braided tube, the apparatus comprising: an at least one elongated core mandrel; an at least one elongated, radially collapsible primary tube sized and configured for removably receiving the at least one elongated core mandrel therewithin, such that the at least one core mandrel is coaxially positionable at least partially within the at least one primary tube, an outer surface of the at least one primary tube configured for the braided tube to be circumferentially formed thereon; and each of the at least one primary tube comprising a plurality of spaced apart primary tube portions circumferentially arranged and configured for cooperating to define said primary tube; whereby, during use of the apparatus, after the braided tube is circumferentially formed on the outer surface of the at least one primary tube, the at least one core mandrel is removed from within the at least one primary tube, thereby allowing the primary tube portions to radially move inwardly toward one another so that braided tube may be disengaged from the at least one primary tube.

2. The braided tube formation apparatus according to embodiment 1, wherein the at least one primary tube has an inner diameter that approximates an outer diameter of the at least one core mandrel.

3. The braided tube formation apparatus according to embodiments 1-2, further comprising an at least one elongated, radially collapsible secondary tube sized and configured for removably receiving the at least one primary tube therewithin, such that the at least one primary tube is coaxially positionable at least partially within the at least one secondary tube, an outer surface of the at least one secondary tube configured for the braided tube to be circumferentially formed thereon; each of the at least one secondary tube comprising a plurality of spaced apart secondary tube portions circumferentially arranged and configured for cooperating to define said secondary tube; whereby, during use of the apparatus, after the braided tube is circumferentially formed on the outer surface of the at least one secondary tube, the at least one core mandrel is removed from within the at least one primary tube, thereby allowing the primary tube portions to radially move inwardly toward one another so that the at least one secondary tube may be disengaged from the at least one primary tube, thereby subsequently allowing the secondary tube portions to radially move inwardly toward one another so that the braided tube may be disengaged from the at least one secondary tube.

4. The braided tube formation apparatus according to embodiments 1-3, wherein the at least one secondary tube has an inner diameter that approximates an outer diameter of the at least one primary tube.

5. The braided tube formation apparatus according to embodiments 1-4, wherein a terminal end of the at least one core mandrel extends a distance beyond the terminal end of the at least one primary tube.

6. The braided tube formation apparatus according to embodiments 1-5, wherein a terminal end of the at least one primary tube extends a distance beyond a terminal end of the at least one secondary tube.

7. The braided tube formation apparatus according to embodiments 1-6, further comprising: a plurality of linearly aligned primary tubes positioned at least partially within the at least one secondary tube; and each of the primary tubes having a core mandrel partially positioned therewithin.

8. The braided tube formation apparatus according to embodiments 1-7, wherein the primary tubes are linearly spaced apart from one another.

9. The braided tube formation apparatus according to embodiments 1-8, further comprising a plurality of linearly aligned secondary tubes.

10. The braided tube formation apparatus according to embodiments 1-9, wherein the secondary tubes are linearly space apart from one another.

11. The braided tube formation apparatus according to embodiments 1-10, wherein each of the at least one primary tube has an outer diameter of between approximately 0.3 millimeters and approximately 58 millimeters.

12. The braided tube formation apparatus according to embodiments 1-11, wherein each of the at least one secondary tube has an outer diameter of between approximately 0.5 millimeters and approximately 60 millimeters.

13. The braided tube formation apparatus according to embodiments 1-12, wherein each of the at least one primary tube has a length of between approximately 5 millimeters and approximately 200 millimeters.

14. The braided tube formation apparatus according to embodiments 1-13, wherein each of the at least one secondary tube has a length of between approximately 5 millimeters and approximately 300 millimeters.

15. The braided tube formation apparatus according to embodiments 1-14, wherein each of the at least one core mandrel, primary tube and secondary tube is substantially circular in cross-section.

16. The braided tube formation apparatus according to embodiments 1-15, wherein: each of the at least one core mandrel and primary tube is substantially circular in cross-section; and the at least one secondary tube is not substantially circular in cross-section.

17. The braided tube formation apparatus according to embodiments 1-16, wherein: the at least one secondary tube is substantially circular in cross-section; and each of the at least one core mandrel and primary tube is not substantially circular in cross-section.

18. The braided tube formation apparatus according to embodiments 1-17, wherein the primary tube portions are positioned so as to define a primary tube space between adjacent ones of each of the primary tube portions.

19. The braided tube formation apparatus according to embodiments 1-18, wherein the secondary tube portions are positioned so as to define a secondary tube space between adjacent ones of each of the secondary tube portions.

20. The braided tube formation apparatus according to embodiments 1-19, wherein the primary tube portions are circumferentially oriented relative to the secondary tube portions such that the primary tube spaces are substantially not aligned with the secondary tube spaces.

21. The braided tube formation apparatus according to embodiments 1-20, wherein: each of the primary tube spaces has a width of between approximately 0.001 inches and approximately 0.005 inches; and each of the secondary tube spaces has a width of between approximately 0.001 inches and approximately 0.010 inches.

22. The braided tube formation apparatus according to embodiments 1-21, wherein the at least one primary tube provides a connector spanning each primary tube space, each connector being constructed out of a deformable material so as to interconnect adjacent ones of each of the primary tube portions while still allowing the primary tube portions to radially move inwardly toward one another when the at least one core mandrel is removed from within the at least one primary tube.

23. The braided tube formation apparatus according to embodiments 1-22, wherein the at least one secondary tube provides a connector spanning each secondary tube space, each connector being constructed out of a deformable material so as to interconnect adjacent ones of each of the secondary tube portions while still allowing the secondary tube portions to radially move inwardly toward one another when the at least one primary tube is removed from within the at least one secondary tube.

24. The braided tube formation apparatus according to embodiments 1-23, wherein the at least one primary tube is removably engaged with the at least one core mandrel, so as to prevent the at least one core mandrel from being unintentionally removed from within the at least one primary tube.

25. The braided tube formation apparatus according to embodiments 1-24, further comprising a temporary engagement material positioned and configured for creating a removable engagement between an inner surface of the at least one primary tube and an outer surface of the at least one core mandrel.

26. The braided tube formation apparatus according to embodiments 1-25, wherein the temporary engagement material is at least one of an adhesive configured for breaking down upon being exposed to specific temperatures, an adhesive configured for breaking down upon being exposed to specific liquid solutions, threading, breakaway structures, magnets, and hook-and-loop fasteners.

27. The braided tube formation apparatus according to embodiments 1-26, wherein the at least one secondary tube is removably engaged with the at least one primary tube, so as to prevent the at least one primary tube from being unintentionally removed from within the at least one secondary tube.

28. The braided tube formation apparatus according to embodiments 1-27, further comprising a temporary engagement material positioned and configured for creating a removable engagement between an inner surface of the at least one secondary tube and the outer surface of the at least one primary tube.

29. The braided tube formation apparatus according to embodiments 1-28, wherein the temporary engagement material is at least one of an adhesive configured for breaking down upon being exposed to specific temperatures, an adhesive configured for breaking down upon being exposed to specific liquid solutions, threading, breakaway structures, magnets, and hook-and-loop fasteners.

30. The braided tube formation apparatus according to embodiments 1-29, further comprising an at least one elongated, radially collapsible intermediate tube positioned coaxially between the at least one primary tube and the at least one secondary tube.

31. The braided tube formation apparatus according to embodiments 1-30, wherein the at least one intermediate tube is removably engaged with each of the at least one primary tube and secondary tube.

32. The braided tube formation apparatus according to embodiments 1-31, further comprising a temporary engagement material positioned and configured for creating a removable engagement between each of the at least one primary tube, intermediate tube and secondary tube.

33. The braided tube formation apparatus according to embodiments 1-32, wherein the temporary engagement material is at least one of an adhesive configured for breaking down upon being exposed to specific temperatures, an adhesive configured for breaking down upon being exposed to specific liquid solutions, threading, breakaway structures, magnets, and hook-and-loop fasteners.

34. The braided tube formation apparatus according to embodiments 1-33, wherein the at least one core mandrel is tubular in structure.

35. The braided tube formation apparatus according to embodiments 1-34, wherein the at least one core mandrel is solid in structure.

36. A braided tube formation apparatus for assisting in the manufacture of a braided tube, the apparatus comprising: an at least one elongated core mandrel; an at least one elongated, radially collapsible primary tube sized and configured for removably receiving the at least one elongated core mandrel therewithin, such that the at least one core mandrel is coaxially positionable at least partially within the at least one primary tube; each of the at least one primary tube comprising a plurality of spaced apart primary tube portions circumferentially arranged and configured for cooperating to define said primary tube; an at least one elongated, radially collapsible secondary tube sized and configured for removably receiving the at least one primary tube therewithin, such that the at least one primary tube is coaxially positionable at least partially within the at least one secondary tube, an outer surface of the at least one secondary tube configured for the braided tube to be circumferentially formed thereon; and each of the at least one secondary tube comprising a plurality of spaced apart secondary tube portions circumferentially arranged and configured for cooperating to define said secondary tube; whereby, during use of the apparatus, after the braided tube is circumferentially formed on the outer surface of the at least one secondary tube, the at least one core mandrel is removed from within the at least one primary tube, thereby allowing the primary tube portions to radially move inwardly toward one another so that the at least one secondary tube may be disengaged from the at least one primary tube, thereby subsequently allowing the secondary tube portions to radially move inwardly toward one another so that the braided tube may be disengaged from the at least one secondary tube.

37. A method for manufacturing a braided tube using the braided tube formation apparatus of claim 36, the method comprising the steps of: wrapping a plurality of wires around the outer surface of the at least one secondary tube of the apparatus via the braiding machine, allowing the wires to cross one another in a desired pattern to form the braided tube on the outer surface of the at least one secondary tube;

applying heat to the wires of the braided tube in order to set the shape of the braided tube; removing the at least one core mandrel of the apparatus from within the at least one primary tube of the apparatus, thereby allowing the at least one primary tube to radially collapse; removing the at least one primary tube from within the at least one secondary tube, thereby allowing the at least one secondary tube to radially collapse; and removing the at least one secondary tube from within the braided tube.

38. The method according to embodiment 37, further comprising the step of positioning the at least one core mandrel within a braiding machine.

39. The method according to embodiments 37-38, further comprising the step of disengaging the at least one core mandrel from the braiding machine.

In closing, regarding the exemplary embodiments of the present invention as shown and described herein, it will be appreciated that a braided tube formation apparatus and associated methods of use are disclosed and configured for manufacturing braided tubes more efficiently and with a relatively higher success rate as compared to traditional methods of manufacture. Because the principles of the invention may be practiced in a number of configurations beyond those shown and described, it is to be understood that the invention is not in any way limited by the exemplary embodiments, but is generally directed to a braided tube formation apparatus and is able to take numerous forms to do so without departing from the spirit and scope of the invention. It will also be appreciated by those skilled in the art that the present invention is not limited to the particular geometries and materials of construction disclosed, but may instead entail other functionally comparable structures or materials, now known or later developed, without departing from the spirit and scope of the invention.

Certain embodiments of the present invention are described herein, including the best mode known to the inventor(s) for carrying out the invention. Of course, variations on these described embodiments will become apparent to those of ordinary skill in the art upon reading the foregoing description. The inventor(s) expect skilled artisans to employ such variations as appropriate, and the inventor(s) intend for the present invention to be practiced otherwise than specifically described herein. Accordingly, this invention includes all modifications and equivalents of the subject matter recited in the claims appended hereto as permitted by applicable law. Moreover, any combination of the above-described embodiments in all possible variations thereof is encompassed by the invention unless otherwise indicated herein or otherwise clearly contradicted by context.

Groupings of alternative embodiments, elements, or steps of the present invention are not to be construed as limitations. Each group member may be referred to and claimed individually or in any combination with other group members disclosed herein. It is anticipated that one or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

Unless otherwise indicated, all numbers expressing a characteristic, item, quantity, parameter, property, term, and so forth used in the present specification and claims are to be understood as being modified in all instances by the term "about." As used herein, the term "about" means that the characteristic, item, quantity, parameter, property, or term so qualified encompasses a range of plus or minus ten percent above and below the value of the stated characteristic, item, quantity, parameter, property, or term. Accordingly, unless indicated to the contrary, the numerical parameters set forth in the specification and attached claims are approximations that may vary. At the very least, and not as an attempt to limit the application of the doctrine of equivalents to the scope of the claims, each numerical indication should at least be construed in light of the number of reported significant digits and by applying ordinary rounding techniques. Notwithstanding that the numerical ranges and values setting forth the broad scope of the invention are approximations, the numerical ranges and values set forth in the specific examples are reported as precisely as possible. Any numerical range or value, however, inherently contains certain errors necessarily resulting from the standard deviation found in their respective testing measurements. Recitation of numerical ranges of values herein is merely intended to serve as a shorthand method of referring individually to each separate numerical value falling within the range. Unless otherwise indicated herein, each individual value of a numerical range is incorporated into the present specification as if it were individually recited herein. Similarly, as used herein, unless indicated to the contrary, the term "substantially" is a term of degree intended to indicate an approximation of the characteristic, item, quantity, parameter, property, or term so qualified, encompassing a range that can be understood and construed by those of ordinary skill in the art.

Use of the terms "may" or "can" in reference to an embodiment or aspect of an embodiment also carries with it the alternative meaning of "may not" or "cannot." As such, if the present specification discloses that an embodiment or an aspect of an embodiment may be or can be included as part of the inventive subject matter, then the negative limitation or exclusionary proviso is also explicitly meant, meaning that an embodiment or an aspect of an embodiment may not be or cannot be included as part of the inventive subject matter. In a similar manner, use of the term "optionally" in reference to an embodiment or aspect of an embodiment means that such embodiment or aspect of the embodiment may be included as part of the inventive subject matter or may not be included as part of the inventive subject matter. Whether such a negative limitation or exclusionary proviso applies will be based on whether the negative limitation or exclusionary proviso is recited in the claimed subject matter.

The terms "a," "an," "the" and similar references used in the context of describing the present invention (especially in the context of the following claims) are to be construed to cover both the singular and the plural, unless otherwise indicated herein or clearly contradicted by context. Further, ordinal indicators—such as "first," "second," "third," etc.—for identified elements are used to distinguish between the elements, and do not indicate or imply a required or limited number of such elements, and do not indicate a particular position or order of such elements unless otherwise specifically stated. All methods described herein can be performed in any suitable order unless otherwise indicated herein or otherwise clearly contradicted by context. The use of any and all examples, or exemplary language (e.g., "such as") provided herein is intended merely to better illuminate the present invention and does not pose a limitation on the scope of the invention otherwise claimed. No language in the present specification should be construed as indicating any non-claimed element essential to the practice of the invention.

When used in the claims, whether as filed or added per amendment, the open-ended transitional term "comprising" (along with equivalent open-ended transitional phrases thereof such as "including," "containing" and "having") encompasses all the expressly recited elements, limitations, steps and/or features alone or in combination with un-recited subject matter; the named elements, limitations and/or features are essential, but other unnamed elements, limitations and/or features may be added and still form a construct within the scope of the claim. Specific embodiments disclosed herein may be further limited in the claims using the closed-ended transitional phrases "consisting of" or "consisting essentially of" in lieu of or as an amendment for "comprising." When used in the claims, whether as filed or added per amendment, the closed-ended transitional phrase "consisting of" excludes any element, limitation, step, or feature not expressly recited in the claims. The closed-ended transitional phrase "consisting essentially of" limits the scope of a claim to the expressly recited elements, limitations, steps and/or features and any other elements, limitations, steps and/or features that do not materially affect the basic and novel characteristic(s) of the claimed subject matter. Thus, the meaning of the open-ended transitional phrase "comprising" is being defined as encompassing all the specifically recited elements, limitations, steps and/or features as well as any optional, additional unspecified ones. The meaning of the closed-ended transitional phrase "consisting of" is being defined as only including those elements, limitations, steps and/or features specifically recited in the claim, whereas the meaning of the closed-ended transitional phrase "consisting essentially of" is being defined as only including those elements, limitations, steps and/or features specifically recited in the claim and those elements, limitations, steps and/or features that do not materially affect the basic and novel characteristic(s) of the claimed subject matter. Therefore, the open-ended transitional phrase "comprising" (along with equivalent open-ended transitional phrases thereof) includes within its meaning, as a limiting case, claimed subject matter specified by the closed-ended transitional phrases "consisting of" or "consisting essentially of." As such, embodiments described herein or so claimed with the phrase "comprising" are expressly or inherently unambiguously described, enabled and supported herein for the phrases "consisting essentially of" and "consisting of."

Any claims intended to be treated under 35 U.S.C. § 112(f) will begin with the words "means for," but use of the term "for" in any other context is not intended to invoke treatment under 35 U.S.C. § 112(f). Accordingly, Applicant reserves the right to pursue additional claims after filing this application, in either this application or in a continuing application.

It should be understood that the methods, and the order in which the respective elements of each method are performed, are purely exemplary. Depending on the implementation, they may be performed in any order or in parallel, unless indicated otherwise in the present disclosure.

All patents, patent publications, and other publications referenced and identified in the present specification are individually and expressly incorporated herein by reference in their entirety for the purpose of describing and disclosing, for example, the compositions and methodologies described in such publications that might be used in connection with the present invention. These publications are provided solely for their disclosure prior to the filing date of the present application. Nothing in this regard should be construed as an admission that the inventors are not entitled to antedate such disclosure by virtue of prior invention or for any other reason. All statements as to the date or representation as to the contents of these documents is based on the information available to the applicants and does not constitute any admission as to the correctness of the dates or contents of these documents.

While aspects of the invention have been described with reference to at least one exemplary embodiment, it is to be clearly understood by those skilled in the art that the invention is not limited thereto. Rather, the scope of the invention is to be interpreted only in conjunction with the appended claims and it is made clear, here, that the inventor (s) believe that the claimed subject matter is the invention.

What is claimed is:

1. A braided tube formation apparatus for assisting in the manufacture of a braided tube, the apparatus comprising:

an at least one elongated core mandrel;

an at least one elongated, radially collapsible outer tube comprised of a plurality of separate and distinct circumferentially spaced apart outer tube portions, the at least one outer tube sized and configured for removably receiving the at least one elongated core mandrel therewithin, such that the at least one core mandrel is coaxially positionable at least partially within the at least one outer tube for temporarily preventing the at least one outer tube from radially collapsing; and an outer surface of the at least one outer tube configured for the braided tube to be circumferentially formed thereon; and whereby, during use of the apparatus, after the braided tube is circumferentially formed on the outer surface of the at least one outer tube, the at least one core mandrel is removed from within the at least one outer tube, thereby allowing the outer tube portions to radially move inwardly toward one another so that the braided tube may be disengaged from the at least one outer tube.

2. The braided tube formation apparatus of claim 1, wherein the at least one outer tube has an inner diameter that approximates an outer diameter of the at least one core mandrel.

3. The braided tube formation apparatus of claim 1, further comprising:

an at least one elongated, radially collapsible inner tube comprised of a plurality of separate and distinct circumferentially spaced apart inner tube portions, the at least one inner tube sized and configured for being coaxially positioned at least partially within the at least one outer tube for preventing the at least one outer tube from radially collapsing, the at least one inner tube further sized and configured for removably receiving the at least one elongated core mandrel therewithin, such that the at least one core mandrel is coaxially positionable at least partially within the at least one inner tube for temporarily preventing the at least one inner tube from radially collapsing ;

whereby, during use of the apparatus, after the braided tube is circumferentially formed on the outer surface of the at least one outer tube, the at least one core mandrel is removed from within the at least one inner tube, thereby allowing the inner tube portions to radially move inwardly toward one another so that the at least one outer tube may be disengaged from the at least one inner tube, thereby subsequently allowing the outer tube portions to radially move inwardly toward one another so that the braided tube may be disengaged from the at least one outer tube.

4. The braided tube formation apparatus of claim 3, wherein the at least one outer tube has an inner diameter that approximates an outer diameter of the at least one inner tube.

5. The braided tube formation apparatus of claim 1, wherein a terminal end of the at least one core mandrel extends a distance beyond the terminal end of the at least one outer tube.

6. The braided tube formation apparatus of claim 3, wherein a terminal end of the at least one inner tube extends a distance beyond a terminal end of the at least one outer tube.

7. The braided tube formation apparatus of claim 3, further comprising:

a plurality of linearly aligned inner tubes positioned at least partially within the at least one outer tube; and each of the inner tubes having a core mandrel partially positioned therewithin.

8. The braided tube formation apparatus of claim 7, wherein the inner tubes are linearly spaced apart from one another.

9. The braided tube formation apparatus of claim 3, wherein each of the at least one core mandrel, outer tube and inner tube is substantially circular in cross-section.

10. The braided tube formation apparatus of claim 3, wherein:

each of the at least one core mandrel and inner tube is substantially circular in cross- section; and the at least one outer tube is not substantially circular in cross-section.

11. The braided tube formation apparatus of claim 3, wherein:

the at least one outer tube is substantially circular in cross-section; and each of the at least one core mandrel and inner tube is not substantially circular in cross-section.

12. The braided tube formation apparatus of claim 3, wherein the outer tube portions are positioned so as to define a substantially longitudinally oriented outer tube space between adjacent ones of each of the outer tube portions.

13. The braided tube formation apparatus of claim 12, wherein the inner tube portions are positioned so as to define a substantially longitudinally oriented inner tube space between adjacent ones of each of the inner tube portions.

14. The braided tube formation apparatus of claim 13, wherein the outer tube portions are circumferentially oriented relative to the inner tube portions such that the outer tube spaces are substantially not aligned with the inner tube spaces.

15. The braided tube formation apparatus of claim 1, wherein the at least one outer tube is removably engaged with the at least one core mandrel, so as to prevent the at least one core mandrel from being unintentionally removed from within the at least one outer tube.

16. The braided tube formation apparatus of claim 15, further comprising a temporary engagement material positioned and configured for creating a removable engagement between an inner surface of the at least one outer tube and an outer surface of the at least one core mandrel.

17. The braided tube formation apparatus of claim 3, wherein the at least one outer tube is removably engaged with the at least one inner tube, so as to prevent the at least one inner tube from being unintentionally removed from within the at least one outer tube.

18. The braided tube formation apparatus of claim 17, further comprising a temporary engagement material positioned and configured for creating a removable engagement between an inner surface of the at least one outer tube and the outer surface of the at least one inner tube.

19. A braided tube formation apparatus for assisting in the manufacture of a braided tube, the apparatus comprising:

an at least one elongated core mandrel;

an at least one elongated, radially collapsible inner tube comprised of a plurality of separate and distinct circumferentially spaced apart inner tube portions, the at least one inner tube sized and configured for removably receiving the at least one elongated core mandrel therewithin, such that the at least one core mandrel is coaxially positionable at least partially within the at least one inner tube for temporarily preventing the at least one inner tube from radially collapsing;

an at least one elongated, radially collapsible outer tube comprised of a plurality of separate and distinct circumferentially spaced apart outer tube portions, the at least one outer tube sized and configured for removably receiving the at least one inner tube therewithin, such that the at least one inner tube is coaxially positionable at least partially within the at least one outer tube for temporarily preventing the at least one outer tube from radially collapsing; and an outer surface of the at least one outer tube configured for the braided tube to be circumferentially formed thereon;

whereby, during use of the apparatus, after the braided tube is circumferentially formed on the outer surface of the at least one outer tube, the at least one core mandrel is removed from within the at least one inner tube, thereby allowing the inner tube portions to radially move inwardly toward one another so that the at least one outer tube may be disengaged from the at least one inner tube, thereby subsequently allowing the outer tube portions to radially move inwardly toward one another so that the braided tube may be disengaged from the at least one outer tube.

20. A method for manufacturing a braided tube using the braided tube formation apparatus of claim 19, the method comprising the steps of:

wrapping a plurality of wires around the outer surface of the at least one outer tube of the apparatus via a braiding machine, allowing the wires to cross one another in a desired pattern to form the braided tube on the outer surface of the at least one outer tube;

applying heat to the wires of the braided tube in order to set the shape of the braided tube;

removing the at least one core mandrel of the apparatus from within the at least one inner tube of the apparatus, thereby allowing the at least one inner tube to radially collapse;

removing the at least one inner tube from within the at least one outer tube, thereby allowing the at least one outer tube to radially collapse; and removing the at least one outer tube from within the braided tube.

* * * * *